US007216568B1

(12) United States Patent
Hsieh

(10) Patent No.: US 7,216,568 B1
(45) Date of Patent: May 15, 2007

(54) RATCHET SOCKET SPANNER

(76) Inventor: Chih-Ching Hsieh, 235 Chung-Ho Box 8-24, Taichung (TW)

( * ) Notice: Subject to any disclaimer, the term of this patent is extended or adjusted under 35 U.S.C. 154(b) by 0 days.

(21) Appl. No.: 11/394,244

(22) Filed: Mar. 31, 2006

(51) Int. Cl.
*B25B 13/46* (2006.01)
*B25B 13/06* (2006.01)
*B25B 13/00* (2006.01)

(52) U.S. Cl. ..... 81/63.2; 81/124.3

(58) Field of Classification Search ..... 81/60, 81/63.2, 121.1, 124.3–124.5, 180.1
See application file for complete search history.

(56) References Cited

U.S. PATENT DOCUMENTS 1,494,513 A * 5/1924 Stewart et al. ..... 81/61
4,840,094 A * 6/1989 Macor ..... 81/185
5,007,311 A * 4/1991 Lee ..... 81/61
5,857,390 A * 1/1999 Whiteford ..... 81/62
6,389,931 B1 * 5/2002 Delaney et al. ..... 81/60
6,901,824 B1 * 6/2005 Chen ..... 81/63.2
6,945,142 B1 * 9/2005 Chen ..... 81/124.3
6,962,100 B2 * 11/2005 Hsien ..... 81/186
7,000,505 B2 * 2/2006 Hsien ..... 81/121.1

* cited by examiner

*Primary Examiner*—David B. Thomas

(57) ABSTRACT

A ratchet socket spanner includes a handle having a driving head at one end; the driving head having a penetrating hole for receiving a socket; the driving head having a receiving groove; the receiving groove serving for receiving a teethed block; a socket having a stepped structure formed by a first end portion and a second end portion; the first end portion being wholly received in the penetrating hole; a periphery of the first end portion having ratchet teeth which is engageable with the teethed block in the receiving groove; an inner side of the first end portion being formed with a first engaging portion; the first engaging portion serving for movably receiving a push unit; the push unit being retained in the penetrating hole; the second end portion protruding out of the penetrating hole; an inner side of the second end portion being a second engaging portion.

1 Claim, 4 Drawing Sheets

RATCHET SOCKET SPANNER

FIELD OF THE INVENTION

The present invention relates to spanner, and in particular to a ratchet socket spanner for improving the defect of the prior art. In the present invention a push unit is designed to make the work of detaching one socket from another one become easy.

BACKGROUND OF THE INVENTION

In the prior art, the ratchet socket spanner is formed by a ratchet spanner and a socket. In use the socket is engaged to the ratchet spanner. There are various kinds of sockets for fitting different kinds of screw devices. Thus, the ratchet spanner is engaged to different sockets according to the screw device to be driven.

However the prior art ratchet socket spanner has the following disadvantages. Firstly, there are many sockets being engaged to the ratchet spanner. Thereby, it is necessary to detach and attaché the sockets frequently so that the teeth of the ratchet spanner and sockets are easy to wear and thus the engagement of the socket and the ratchet spanner is loose. In use, the force cannot be effectively transferred to the screw device. It is possible the ratchet spanner slides along the outer surface of the socket so that the force is not transferred to the driving object. Moreover if it is desired to drive an object in a deep place, it may be that several sockets must be serially connected. These sockets are connected one by one. The connection of different sockets is performed by a C ring in one socket to clamp another socket. However it is difficult to withdraw one socket from another socket, especially as the user's hand is oiled. As a whole, the prior art design is not an ideal one and it necessary to be improved.

SUMMARY OF THE INVENTION

Accordingly, the primary object of the present invention is to provide a ratchet socket spanner for improving the defect of the prior art. In the present invention a push unit is designed to make the work of detaching one socket from another one become easy.

To achieve above objects, the present invention provides a ratchet socket spanner which comprises a handle having a driving head at one end; the driving head having a penetrating hole for receiving a socket; the driving head having a receiving groove which is communicated to the penetrating hole; the receiving groove serving for receiving a teethed block; a socket having a stepped structure formed by a first end portion and a second end portion; the first end portion being wholly received in the penetrating hole; a periphery of the first end portion having ratchet teeth which is engageable with the teethed block in the receiving groove; an inner side of the first end portion being formed with a first engaging portion; the first engaging portion serving for movably receiving a push unit; the push unit being retained in the penetrating hole; the second end portion protruding out of the penetrating hole; an inner side of the second end portion being a second engaging portion.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
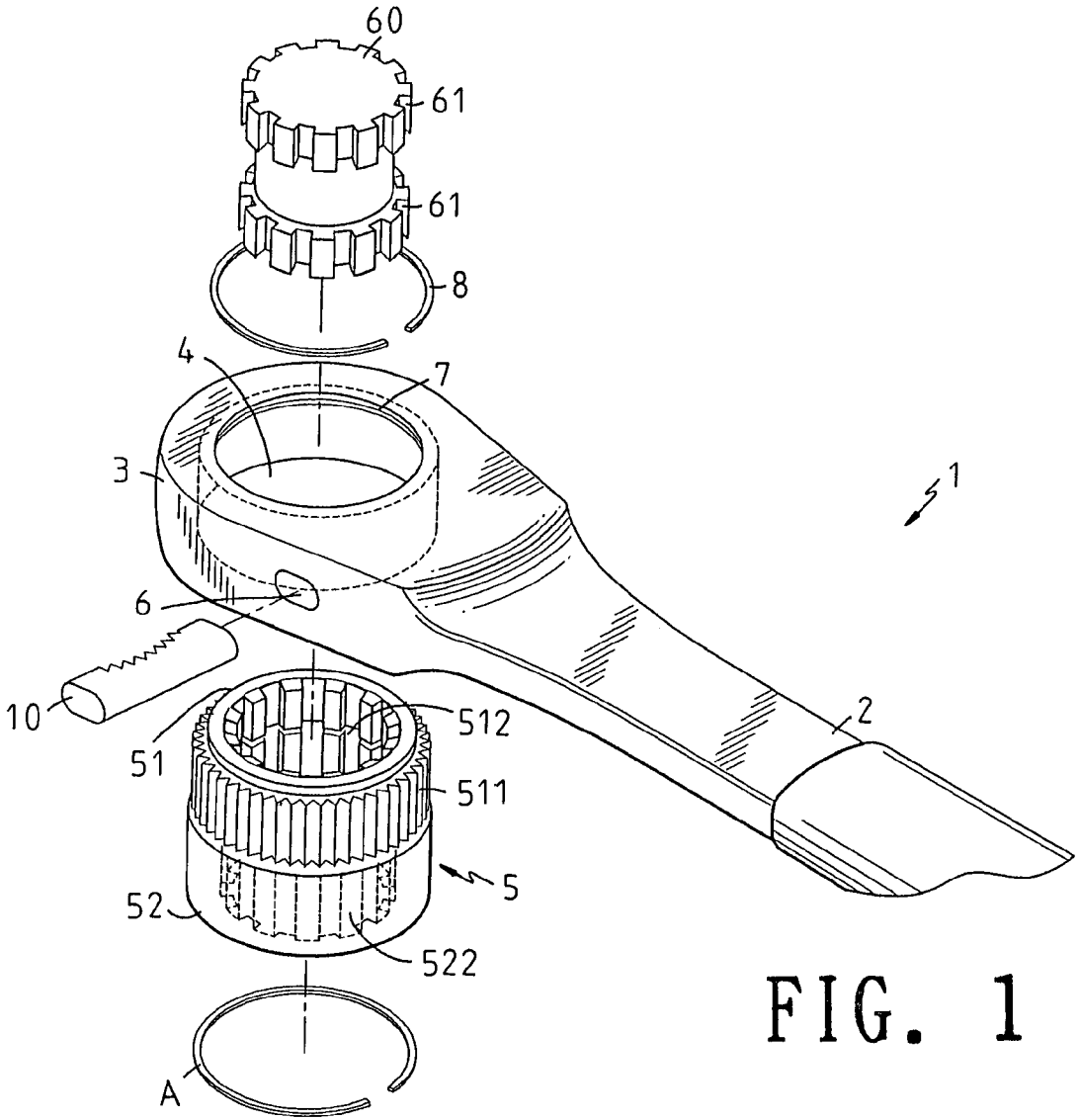
FIG. 1 is an exploded perspective view of the ratchet socket spanner of the present invention.
Figures 2, 3:
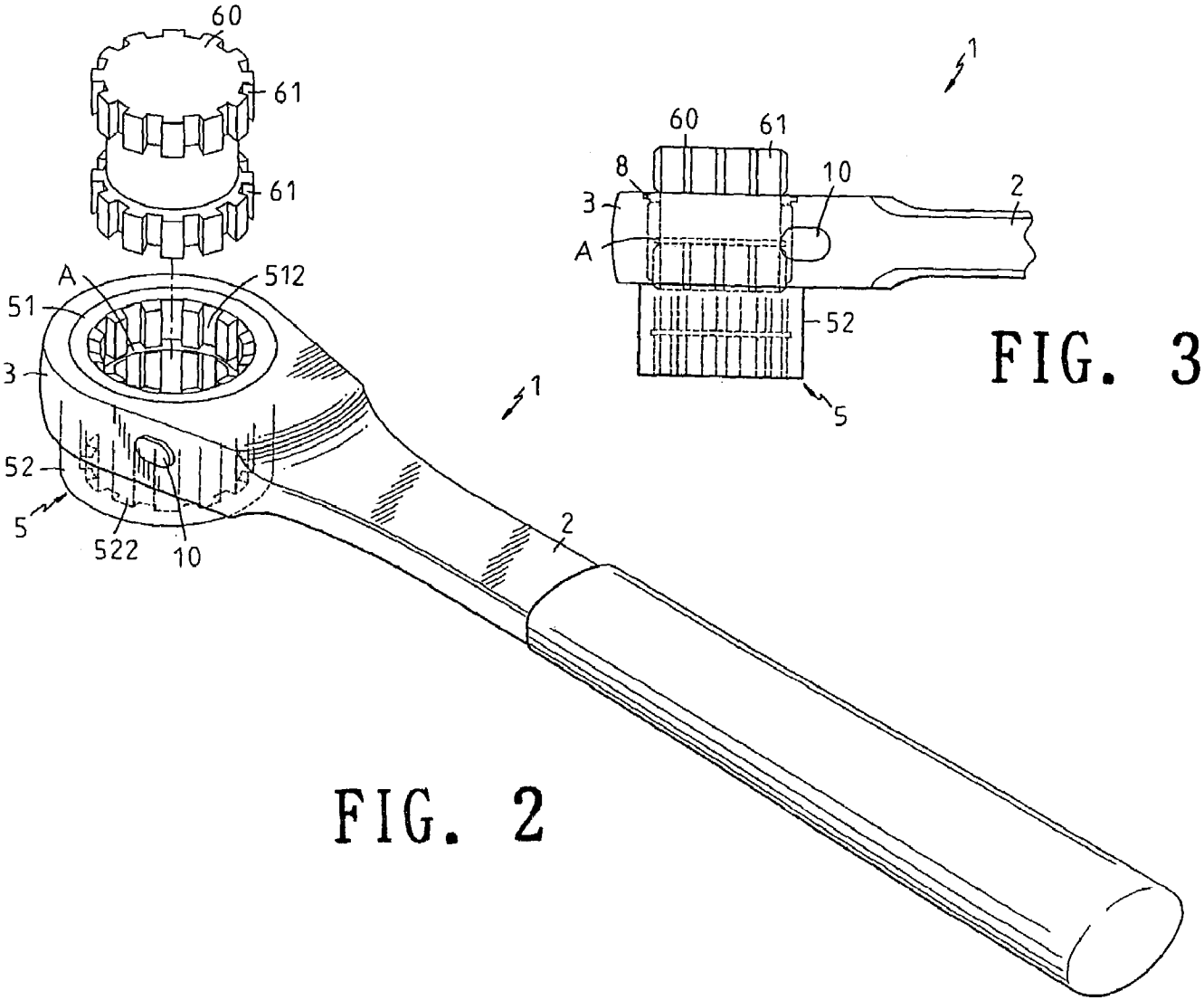
FIG. 2 is a schematic perspective view of the ratchet socket spanner of the present invention.
FIG. 3 is a perspective view about the driving head and the socket of the ratchet socket spanner of the present invention.

Referring to FIGS. 1 to 3, the ratchet socket spanner 1 of the present invention is illustrated. The present invention has the following elements.

A handle 2 has a driving head 3 at one end. The driving head 3 has a penetrating hole 4 for receiving a socket 5. The driving head 3 has a receiving groove 6 which is communicated to the penetrating hole 4. The receiving groove 6 serves to receive a teethed block 10. An upper side of an inner wall of the penetrating hole 4 has an annular groove 7. A C ring 8 is installed in the annular groove 7.

The socket 5 has a stepped structure formed by a first end portion 51 and a second end portion 52. The first end portion 51 is wholly received in the penetrating hole 4. A periphery of the first end portion 51 has ratchet teeth 511 which is engageable with the teethed block 10 in the receiving groove 41. An inner side of the first end portion 51 is formed with a first engaging portion 512 which has twelve teeth. The first engaging portion 512 serves to movably receive a push unit 60. The push unit 60 has flanges 61 at an upper side and an lower side thereof and each flanged has a plurality of teeth. In assembly, the push unit 60 is retained in the penetrating hole 4 by the confinement of the C ring 8.

Furthermore, the second end portion 52 protrudes out of the penetrating hole 4. In this embodiment, the second end portion 52 has smoother outer surface. The inner side of the second end portion 52 is a second engaging portion 522 which has twelve teeth. Or the second engaging portion 522 may be formed as a hexagonal hole.

In the present invention, the ratchet teeth 511 at the periphery of the first end portion 51 of the socket 5 is used to combine with the tool body so as to improve the defect of structural wearing in the prior art.

In the present invention, the socket 5 is engaged to the handle 2. In use, the second engaging portion 522 in the inner side of the second end portion 52 of the socket 5 can be used to engage a screw unit (not shown). Moreover to have more uses, another socket can be engaged with the second engaging portion 522 so as to be engaged to screw means of other sizes, as shown in FIGS. 4 and 5.

Furthermore, in the present invention, the thicknesses of the first end portion 51 and second end portion 52 of the socket 5 can be equal so that the second engaging portion 522 has a larger engaging area. Furthermore, the ratchet teeth 511 of the first end portion 51 has a larger area to engage the teethed block 10. Further the thicknesses of the first end portion 51 and second end portion 52 of the socket 5 are equal so that the present invention can provide a great twisting force to a driving object.

Figure 5:
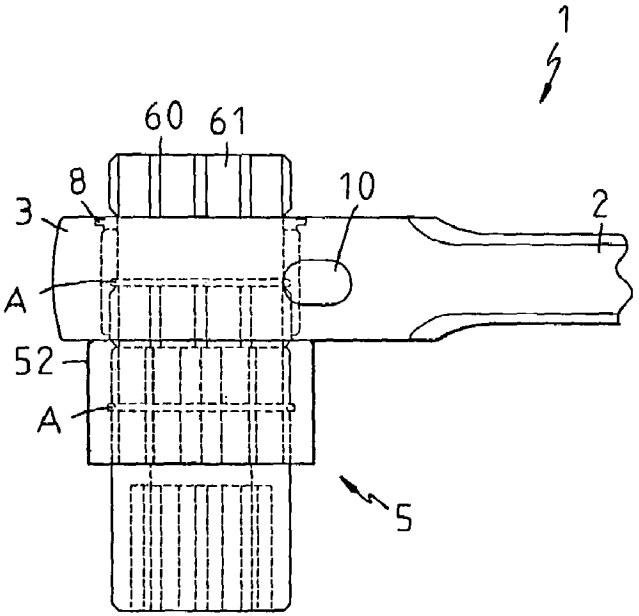
FIG. 5 is a schematic cross sectional view of FIG. 4 of the present invention.
Figure 4:
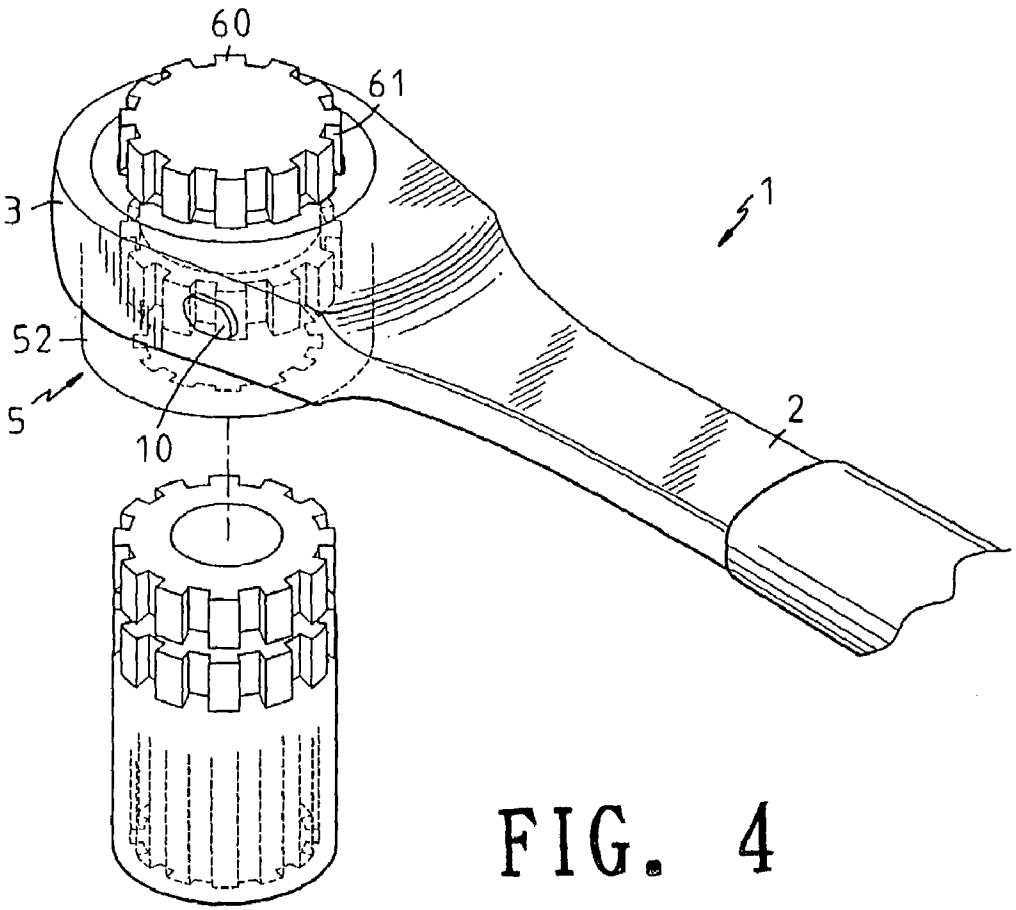
FIG. 4 is an exploded perspective view about the combination of the ratchet socket spanner of the present invention, wherein the ratchet socket spanner is combined with another socket.

Referring to FIGS. 1, 4, and 5, in the present invention, a wall surface of each of the first engaging portion 512 and second engaging portion 522 is formed with an annular groove for receiving a C ring A. The annular groove of the second engaging portion 522 serves for receiving a C ring. The annular groove of the first engaging portion 512 serves for receiving a C ring A. When the push unit 60 is pushed into the first engaging portion 512, the C ring A is expanded for receiving the push unit 60. After the push unit 60 is positioned, the C ring A will clamp at an upper portion of the lower flange of the push unit 60. The number of the teeth in the flange of the push unit 60 is preferably 6 or 12.

Figure 7:
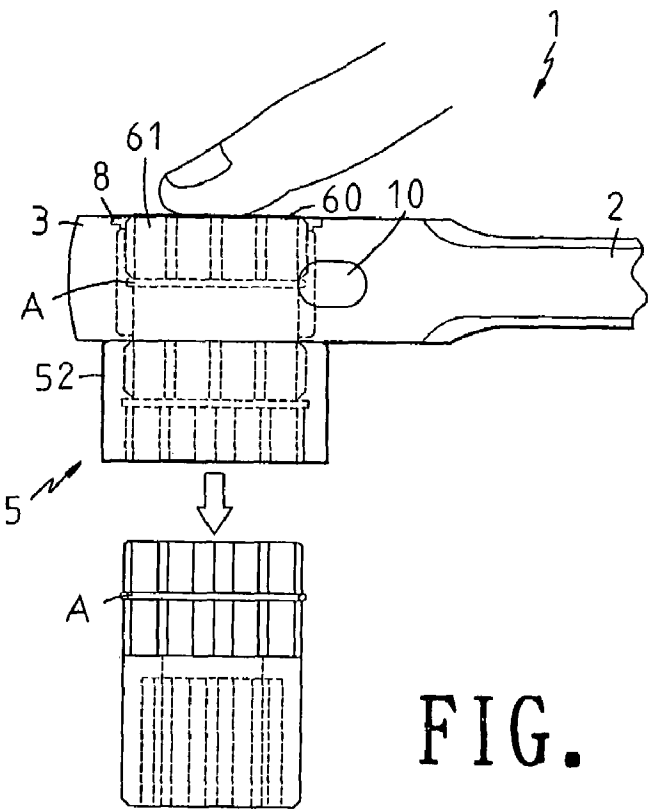
FIG. 7 is a schematic view showing that the push unit of the ratchet socket spanner is pushed for retracting the socket from the head of the ratchet socket spanner of the present invention.
Figure 6:
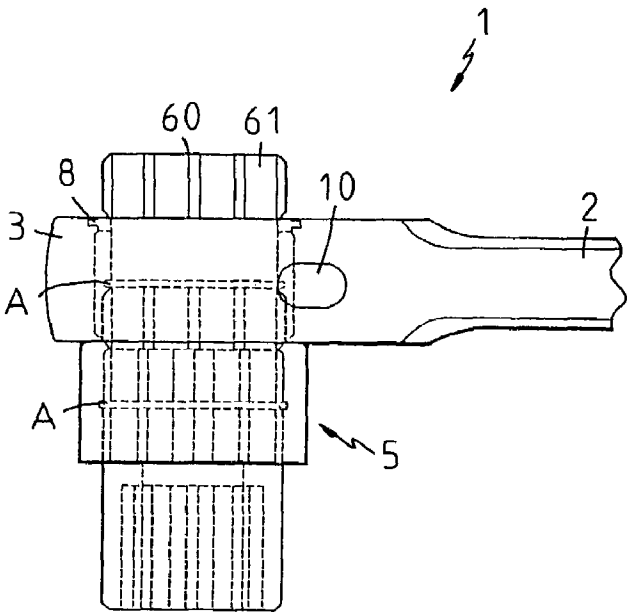
FIG. 6 is a perspective view showing that the ratchet socket spanner of the present invention is used for driving a screw nut by using the second engaging portion thereof.

When the push unit 60 is pushed downwards, the socket 5 will also move downwards, as shown in FIG. 7. Thus, the socket 5 can be taken out.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A ratchet socket spanner comprising:

a handle having a driving head at one end; the driving head having a penetrating hole for receiving a socket; the driving head having a receiving groove which is communicated to the penetrating hole; the receiving groove serving for receiving a teethed block;

a socket having a stepped structure formed by a first end portion and a second end portion;

the first end portion being wholly received in the penetrating hole; a periphery of the first end portion having ratchet teeth which is engageable with the teethed block in the receiving groove; an inner side of the first end portion being formed with a first engaging portion, for movably receiving a push unit; the push unit being retained in the penetrating hole;

the second end portion protruding out of the penetrating hole; an inner side of the second end portion being a second engaging portion; and wherein the push unit having flanges at an upper side and a lower side thereof, each flanged has a plurality of teeth; the push unit being retained in the penetrating hole by the confinement of a C ring.

* * * * *